US008556471B2

(12) United States Patent
Pahlke et al.

(10) Patent No.: US 8,556,471 B2
(45) Date of Patent: Oct. 15, 2013

(54) LIGHTING MODULE, LAMP AND LIGHTING METHOD

(75) Inventors: Monika Pahlke, Munich (DE); Katrin Schroll, Matzing (DE); Hartmut Billy, Holzkirchen (DE); Julius Augustin Muschaweck, Gauting (DE)

(73) Assignees: OSRAM Gesellschaft mit beschraenkter Haftung, Munich (DE); OSRAM Opto Semiconductors GmbH, Regensburg (DE)

( * ) Notice: Subject to any disclaimer, the term of this patent is extended or adjusted under 35 U.S.C. 154(b) by 282 days.

(21) Appl. No.: 12/866,465

(22) PCT Filed: Feb. 6, 2009

(86) PCT No.: PCT/EP2009/000849

§ 371 (c)(1),
(2), (4) Date: Jan. 25, 2011

(87) PCT Pub. No.: WO2009/098081

PCT Pub. Date: Aug. 13, 2009

(65) Prior Publication Data

US 2011/0110083 A1 May 12, 2011

(30) Foreign Application Priority Data

Feb. 6, 2008 (DE) ..... 10 2008 007 723

(51) Int. Cl.
*F21V 5/00* (2006.01)

(52) U.S. Cl.
USPC ..... 362/328; 362/245; 362/302; 362/308; 362/518; 362/520

(58) Field of Classification Search
USPC ..... 362/245, 302, 308, 311.02, 328, 518, 362/520
See application file for complete search history.

(56) References Cited

U.S. PATENT DOCUMENTS

| | | | |
|---|---|---|---|
| 5,582,480 | A | 12/1996 | Zwick et al. |
| 6,582,103 | B1 | 6/2003 | Popovich et al. |
| 6,758,582 | B1 | 7/2004 | Hsiao et al. |
| 6,951,415 | B2 | 10/2005 | Amano et al. |
| 2006/0152820 | A1 | 7/2006 | Lien et al. |
| 2008/0192479 | A1 | 8/2008 | Wanninger |

FOREIGN PATENT DOCUMENTS

| | | | |
|---|---|---|---|
| DE | 10330261 | A1 | 1/2004 |
| DE | 102004043516 | A1 | 3/2006 |
| EP | 0683355 | A1 | 11/1995 |
| EP | 1255132 | A1 | 11/2002 |
| EP | 1453107 | A1 | 9/2004 |

OTHER PUBLICATIONS

English translation of International Preliminary Report on Patentability dated Sep. 7, 2010.
International Search Report of corresponding PCT/EP2009/000849, 2009.
German Search Report of corresponding DE 10 2008 007 723.2, 2008.

*Primary Examiner* — Stephen F Husar
*Assistant Examiner* — Meghan Dunwiddie

(57) ABSTRACT

A lighting module may include a light source; a lens arranged at a distance from the light source; and a reflector; wherein the lens is configured and arranged to have a wide-angle emission characteristic and to direct a proportion of the light incident from the light source onto the reflector, wherein the proportion is at least 30%.

20 Claims, 5 Drawing Sheets

LIGHTING MODULE, LAMP AND LIGHTING METHOD

RELATED APPLICATIONS

The present application is a national stage entry according to 35 U.S.C. §371 of PCT application No.: PCT/EP2009/000849 filed on Feb. 6, 2009, which claims priority from German application No.: 10 2008 007 723.2 filed on Feb. 6, 2008.

TECHNICAL FIELD

Various embodiments relate to a lighting module including a light source, an optical component and a reflector, to a luminaire including such a lighting module, and also to a lighting method.

BACKGROUND

Hitherto, a narrow emission characteristic or an emission characteristic with sharp bright/dark transitions in a lighting module has required a high technical outlay and entails high losses of efficiency. Poor thermal management often arises as a result of a constrained narrow arrangement of LED modules, as a result of extremely dense chip packing and/or as a result of a small distance between a primary light source (LED chip or LED lamp) and a lens disposed downstream.

In order to achieve a wide-angle emission characteristic in a lighting module, a combination of lenses having different emission characteristics or/and a combination of different optical axes of optical units of identical type (tilting of the optical units with respect to one another) is/are known. Narrow emission angles have been realized hitherto using conventional lenses having a low efficiency.

SUMMARY

Various embodiments provide a simple and cost-effective possibility for achieving a wide emission characteristic in a lighting module.

The lighting module includes at least one light source, at least one optical component arranged at a distance from the at least one light source, and at least one reflector. The optical component is configured and arranged to have a wide-angle emission characteristic and to direct a predominant portion of the light incident on the optical component from the light source onto the reflector.

In this case, wide-angle means that the optical component is configured and arranged such that the light intensity maximum does not lie on its optical axis or main radiation direction; light incident on such an optical component, e.g. light from a Lambertian emitter, is therefore emitted predominantly at a specific angle (wide-angle) with respect to the optical axis of the optical component.

A predominant portion is understood to mean a luminous flux of at least 30% of the total luminous flux incident on the optical component.

The light preferably includes visible light, specifically white or colored light, but can alternatively or additionally include e.g. IR light and/or UV light.

It should generally be understood that, when reference is made to elements in the singular, e.g. "one", "a", etc., the plural thereof can also be meant as well, unless specifically explained otherwise.

This device is able to attain sharp imaging, e.g. with a sharp bright/dark boundary, in conjunction with a very compact and brightly radiating construction. This is achieved, inter alia, by the fact that it is possible to circumvent the conformity between imaging sharpness and dimensioning of pure lens systems (etendue) by using the reflector. At the same time, spacing apart the optical unit from the light source ensures that the optical unit is not damaged by an excessively high luminous flux density or temperature. Damage caused by the incident light can be considerable for optical components composed of plastic, in particular, since said components can become dull as a result of the light incident and this reduces the service life of the module. Moreover, the spacing-apart allows simple scalability of the system, e.g. for adaptation to a different number of light sources. In particular, sharp bright/dark transitions in the target region can be used advantageously e.g. in signaling technology, street lighting, automotive lighting, lighting of business premises (so-called "shop lighting"), architectural lighting, etc.

In order to attain a high brightness, in particular in conjunction with a sharp bright/dark boundary, it is preferred if the optical component is configured and arranged to direct a predominant portion of the light incident from the light source onto the reflector. A predominant portion is understood to mean luminous flux of more than 50% of the total luminous flux incident on the optical component.

For this purpose, it is particularly preferred if at least 60%, particularly preferably at least 70%, of the light incident on the optical unit from the light source is directed onto the reflector. The remaining proportion is then typically emitted from the module directly by the optical unit.

It is preferred if at least 90%, even more preferably more than 95%, of the quantity of light emitted by the at least one light source is incident on the optical component. The remaining proportion can—preferably—be incident directly on the reflector or can be emitted directly toward the outside.

Moreover, preference is given to a lighting module wherein the optical component is configured and arranged to emit light along an optical axis with not more than 30%, in particular not more than 20%, of a maximum light intensity (level of the light intensity maximum).

The light sources can be embodied as separately shaped and driven light sources or groups of such light sources. It is preferred if at least one light source, preferably a plurality of light sources, is applied on at least one carrier element; as a result, the illuminance becomes scalable and, if a plurality of light sources are combined in a group, a particularly compact construction is obtained.

Preferably, the carrier element has a plurality of light sources combined in an, in particular rectangular (matrix-like), group of light sources, e.g. in the matrix arrangement 1×2, 1×3, 2×2, 2×3, 3×3 etc. An arrangement of this type makes it possible to install a high light power in a confined space.

Preference may be given to a lighting module wherein the plurality of light sources radiate in the same color, in particular white.

Preference may be given to a lighting module wherein at least two light sources radiate in different colors with respect to one another, particularly if the light sources generate a white mixed light. Thus, light sources can preferably be used in a combination RGB (e.g. RGB, RGGB, RRGB, RGBB etc.) or additionally, for producing a "warm" white hue, with a yellow ("amber") hue. In the case of six light sources, the combination RGGBAA, for example, may be preferred.

It is particularly preferred if the light source(s) is or are embodied as light emitting diode(s), LED(s). In this case, the type of LED is not restricted and can include, for example, inorganic LEDs or organic LEDs (OLEDs). The use of surface mounted LEDs or of chip arrays based on chip-on-board or comparable technologies is preferred.

As an alternative to the use of light emitting diodes, e.g. laser diodes or other compact light sources can also be used.

In order to reduce a thermal loading and a radiation loading, preference is given to a lighting module wherein a light entrance surface—facing the light source(s)—of the optical component is arranged at a distance of at least 2.5 mm, preferably of at least 5 mm, from a surface of the light source. As the distance increases, the loading of the optical component decreases further, for which reason a distance of more than 5 mm is preferable compared with smaller distances.

Preference is also given to a lighting module wherein a light entrance surface—facing the light source—of the optical component is arranged at a distance from a surface of the light source which corresponds to at least the maximum linear dimension, in particular to at least twice the maximum linear dimension, of the light source and/or of the group of light sources. In this case, the maximum linear dimension should be regarded as the maximum distance between two points situated on the outer contour of the LED or of the group of LEDs. By means of the arrangement according to the invention, independently of the absolute size of the LED, a sufficient distance between lens and LED is likewise achieved in order to ensure the function of the lens even in long-term operation.

Preference is furthermore given to a lighting module wherein a light entrance surface—facing the light source—of the optical component is arranged at a distance from a surface of the LED which corresponds to at least one quarter of a diameter of the light entrance surface of the optical component, in particular to at least one third of the diameter of the light entrance surface of the optical component. This also ensures that the thermal stress of the lens is reliably reduced independently of the absolute size thereof and no heat accumulation arises between LED and lens.

Preference is furthermore given to a lighting module wherein the light entrance surface—facing the light source—of the optical component is arranged at a distance of at most 30 mm, preferably of at most 20 mm, from the surface of the light source. This ensures that the radiation emitted by the LED reaches the lens with the fewest possible losses and, in addition, a compact arrangement is obtained.

Preference is given, moreover, to a lighting module wherein the light entrance surface—facing the—of the optical component is arranged at a distance from the surface of the light source which corresponds at most to eight times the maximum linear dimension, preferably at most five times the maximum linear dimension, of the light source and/or the group of light source. This also ensures that, independently of the absolute size of the LED or the group of LEDs, the radiation emitted by the LED arrives at the lens in a sufficient concentration and a compact construction is obtained.

Preference is also given to a lighting module wherein a light entrance surface—facing the light source—of the optical component is arranged at a distance from the surface of the LED which corresponds at most to one and a half times the diameter of the light entrance surface of the optical component, in particular at most to the diameter of the light entrance surface of the optical component. This also ensures a compact design with good luminous efficiency.

Distance can be taken to mean either a distance along a specific axis, e.g. a coordinate axis, (level distance) or else—preferably—the shortest distance between a radiating surface of a light source and the light entrance surface of the optical component. The coordinate axis is then preferably that axis which indicates a mounting position between light sources and optical component.

The optical component is generally an optical component having a wide-angle characteristic, in particular a light-transmitting optical component such as a lens or a diffraction grating, but can also be configured as a non-light-transmitting optical component, such as a reflector. Combinations with a plurality of any of such optical components are also possible.

Particular preference is given to a lighting module wherein the optical component comprises at least one lens. In particular, a lens arrangement with minimized total reflection is made possible, which brings about a lower sensitivity of the optical unit with respect to manufacturing tolerances and misalignment on account of the low total reflection.

Preference may be given to a lighting module wherein at least one surface of the lens has an aspherical form.

Preference may also be given to a lighting module wherein at least one surface of the lens has a rotationally symmetrical form.

Preference may furthermore be given to a lighting module wherein at least one surface of the lens has an elliptical freeform ("spline").

Preference may furthermore be given to a lighting module wherein a light entrance surface of the lens has a concave cutout ("dome").

However, the use of a diffraction grating may also be preferred as the optical component.

The optical component can also include a reflective surface, e.g. an upside down conical reflector.

For simple and inexpensive production it may be advantageous if the optical component is formed from a transparent polymer as basic material. Polymer materials enable simple and cost-effective shaping even in the case of complex forms, the advantages of the invention having a particularly clear effect in the case of these lenses. However, an optical component composed of glass may also be preferred. Combinations of a plurality of optical components including plastic and/or glass are also possible.

Generally, a single optical component can be used, or a plurality of interacting optical components can be used in order to attain the wide-angle emission characteristic.

The reflector is preferably situated in a beam path of a light intensity maximum.

In order to attain a high luminous efficiency it is preferred if the reflector surrounds the light source(s), in particular the light source(s) and optical unit(s), on all sides perpendicularly to the optical axis or main emission direction. The luminous efficiency and the efficiency are thereby increased since any light emitted toward the side can be concentrated in the direction of the lens or the emission direction.

In order to produce a desired emission geometry and high illuminance in a simple manner, preference is given to a lighting module wherein at least one (partial) reflection surface or sector, e.g. a lateral surface, has at least two facets.

It is advantageous if at least one sector of the reflector has at least 6, preferably between 8 and 20, in particular 10, facets. The faceting brings about a homogenization of the illuminance and color distribution since the imaging of different regions of an LED chip or different LEDs of a group of LEDs can thus overlap.

Particularly in order to attain a sharp bright/dark boundary in conjunction with substantially homogeneous illumination of a target area, it is preferred if at least one reflection surface or a sector of the reflector is provided with facets such that light beams reflected by individual facets, in particular all facets, substantially overlap on the target field or a partial zone thereof. As a result, the desired target field or specific sectors thereof is in each case completely covered preferably by a plurality of light beams emitted by the facets. Consequently, not just a plurality of light cones that do not completely overlap is radiated into the target field, whereby the effect of production tolerances and radiation transitions is also substantially precluded.

It is particularly advantageous, specifically for illuminating rectangular target regions, if the reflector has a—in plan view—rectangular basic form in which the two shorter reflector sides do not have a plurality of facets and the two longer reflector sides each have a plurality of facets.

It may be advantageous if a reflection surface of the reflector has a basic form that is elliptical or parabolic in cross section—with or without introduced facets.

Furthermore, it is advantageous if the reflector is substantially formed from a basic material having good thermal conductivity, in particular aluminum. As a result, the reflector can additionally be used for dissipating heat from the light source(s).

It may be advantageous if the lighting module and/or the optical component has a rotationally symmetrical illumination pattern.

However, a lighting module which has a mirror-symmetrical illumination pattern may also be advantageous.

However, a lighting module which has an asymmetrical illumination pattern may also be advantageous.

Particular preference is given to a lighting module which has a carrier element with one or a plurality of light sources, an optical component and a reflector. However, by way of example, the lighting module can alternatively also have a plurality of carrier elements each with one or a plurality of light sources and a plurality of optical component, e.g. combined to form a plurality of—in particular but not necessarily substantially structurally identical—groups of carrier element (s) and optical unit(s).

The luminaire includes at least one lighting module as described above, in particular a plurality of lighting modules. This luminaire has the advantage that it can be constructed in a simple manner and without complicated setting. It is particularly advantageous that is a planar arrangement of the lighting modules is also possible for cylindrical imaging, as a result of which the heat or thermal management is simplified and greater design freedom is made possible in the case of the luminaire housing.

Particular preference is given to a luminaire which includes a plurality of lighting modules in a matrix arrangement, e.g. a linear ($1\times n$) or rectangular ($n\times m$ where $n, m>1$) arrangement. However, the arrangement of the modules can generally be configured as desired, e.g. also as circular, elliptical or irregular. Identical or differently designed modules can be used together.

The luminaire, particularly with a sharp bright/dark characteristic, can particularly preferably be used as a luminaire for spot lighting, signal lighting or street lighting.

In the case of the lighting method, a predominant portion of a light emitted by at least one light source onto an optical unit arranged at a distance therefrom is directed onto a reflector, wherein the light emitted by the optical unit has a wide-angle emission characteristic.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
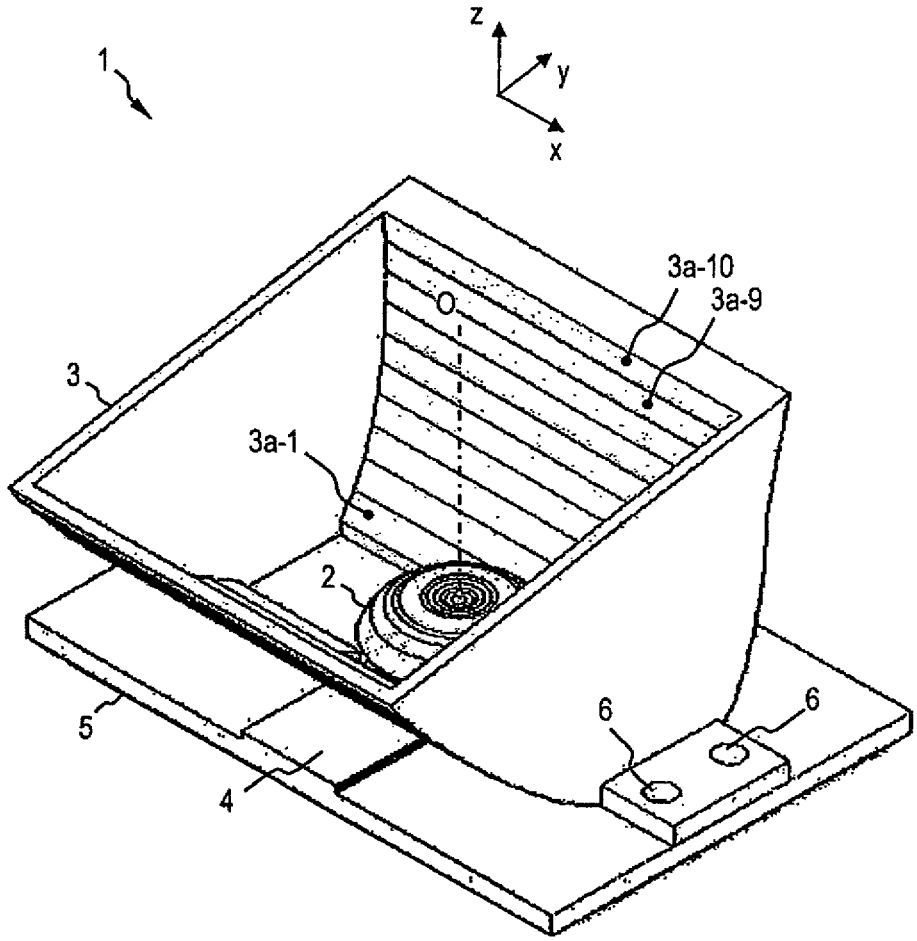
FIG. 1 shows a lighting device in a perspective view.

FIG. 1 shows a lighting module 1 including a combination of at least one light source (not illustrated), and an optical component in the form of a lens 2, said optical component being disposed downstream of said light source at a distance. Furthermore, the lighting device 1 includes a reflector 3 disposed downstream of the lens 2, and furthermore a bonding board 4 for fixing the light source and a base board 5 for fixing the lens 2, the reflector 3 and the bonding board 4. In this case, disposed downstream means that at least part of the light emitted by the (at least one) light source is directly or indirectly incident on the lens 2 or incident on the reflector 3 from the lens 2. The lens 2 and the reflector 3 are therefore arranged at least partly in a manner disposed in series in the beam path of the light emitted by the at least one light source.

In this case, the lens 2 is configured and arranged such that it has a wide-angle emission characteristic and directs a predominant portion (>50%) of the light incident from the light source onto the reflector 3. This means here that the light intensity maximum does not lie on the optical axis O of the lens 2 or the lens 2 in combination with the light source. A possible emission pattern of a wide-angle LED-lens system is presented in greater detail in FIG. 3. In particular, light lobes having light intensity maxima are incident on the reflector 3. Only a relatively small portion (<50%) of the light incident on the lens 2 is emitted directly from the lighting module 1.

In this embodiment, the reflector 3 or its reflection surface is equipped, on two opposite long sides, with reflector sections (facets) 3*a* extending in the width direction (x-direction), which adjoin one another in the height direction (z-direction) and each have a concave surface form. Each of the 10 reflector sections 3*a*, of which only three 3*a*-1, 3*a*-9, 3*a*-10 are provided with reference symbols for reasons of clarity, is inclined about the x-axis relative to the other reflector sections 3*a*. The shorter reflector sides are provided with a smooth surface without facets. The form of the reflector 3 is not symmetrical with respect to the (x, z) plane, rather the reflector 3 is inclined toward one side, such that a main emission direction of the lighting module 1 is inclined relative to the optical axis O. The reflector 3 is produced from an aluminum alloy, as a result of which it can be used for dissipating heat from the light source. On the inner side (reflection surface), it is provided with a suitable reflective coating.

By means of using this lighting module 1, a highly homogeneously illuminated target field can be achieved in a compact manner that is simple to produce, said target field additionally enabling a high boundary sharpness between different illumination regions or with respect to the non-illuminated region (bright/dark boundary). In particular, the conformity between imaging sharpness and dimensioning of pure lens systems (etendue) can be circumvented by using the reflector 3. Sharp bright/dark transitions in the target region are desired particularly in the areas of signaling technology, street lighting, automotive lighting, business lighting and architectural lighting.

For the purpose of simple mounting, drilled holes 6 for leading through fixing elements, e.g. screws, are provided on the base board.

Figure 2:
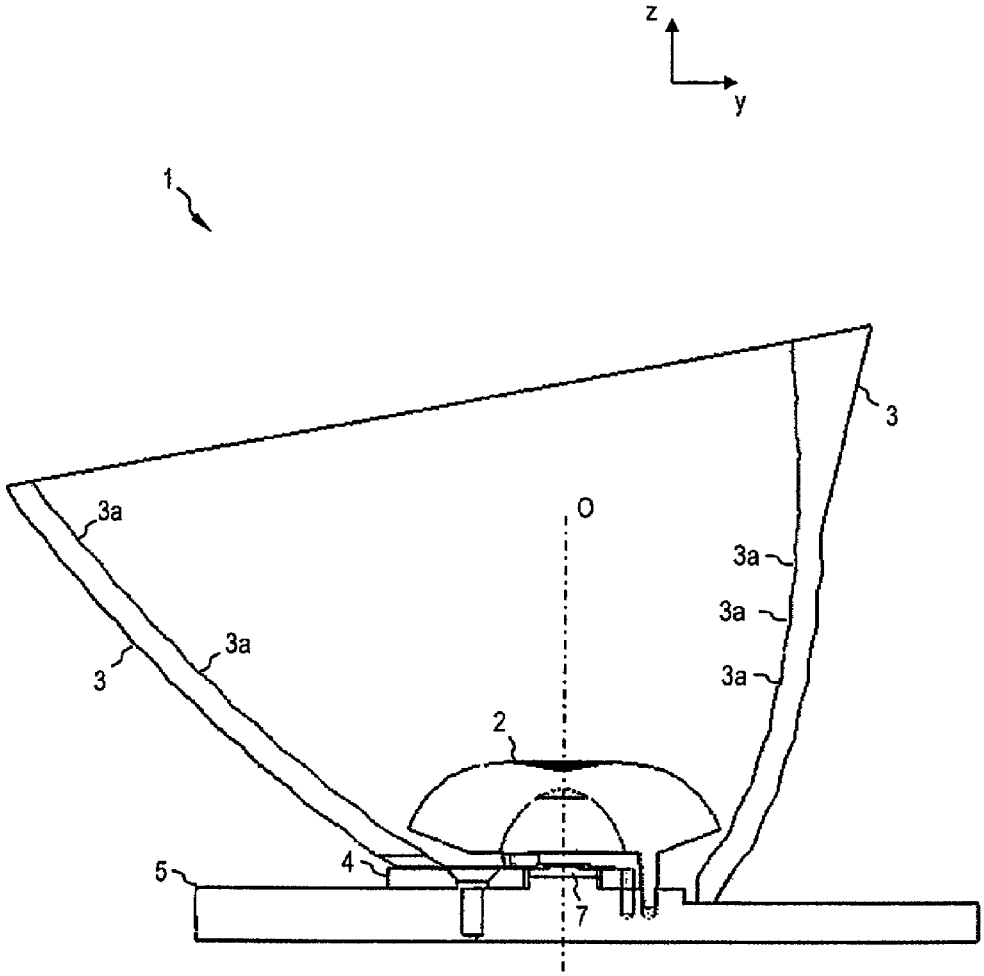
FIG. 2 shows the lighting device from FIG. 1 as a sectional illustration.

FIG. 2 shows the lighting device 1 from FIG. 1 as a sectional illustration through the center of the lens 2 in a sectional plane parallel to the (y, z) plane. The two longitudinal walls of the reflector 3 extending in the x-direction are not shaped or arranged symmetrically with respect to the optical axis O through the lens 2. Rather, one of the walls (the left-hand wall in this illustration) of the reflector 3 is angled to a greater extent from the optical axis O, that is to say has a wider opening with regard thereto, while the other side (here: the right-hand side) of the reflector 3 is arranged closer to the optical axis O and thus forms a generally smaller opening angle with the latter. As a result, light emitted by the lens 2 is principally emitted toward the left. By virtue of the fact that the lens 2 emits a large portion of the light incident on it from the light source 7 in a wide-angle fashion, a large portion of the light emitted by the light source 6 is also incident on the reflector 3, as will be described in greater detail with reference to FIG. 4. On account of the structuring 3*a* of the reflector surface, the partial light beams of the individual facets 3*a* (which in this case are provided with reference symbols only for the left-hand reflector side, and even there only in some instances) are substantially superimposed, as a result of which the illuminance and illumination color on the target area are homogenized.

Figure 3:
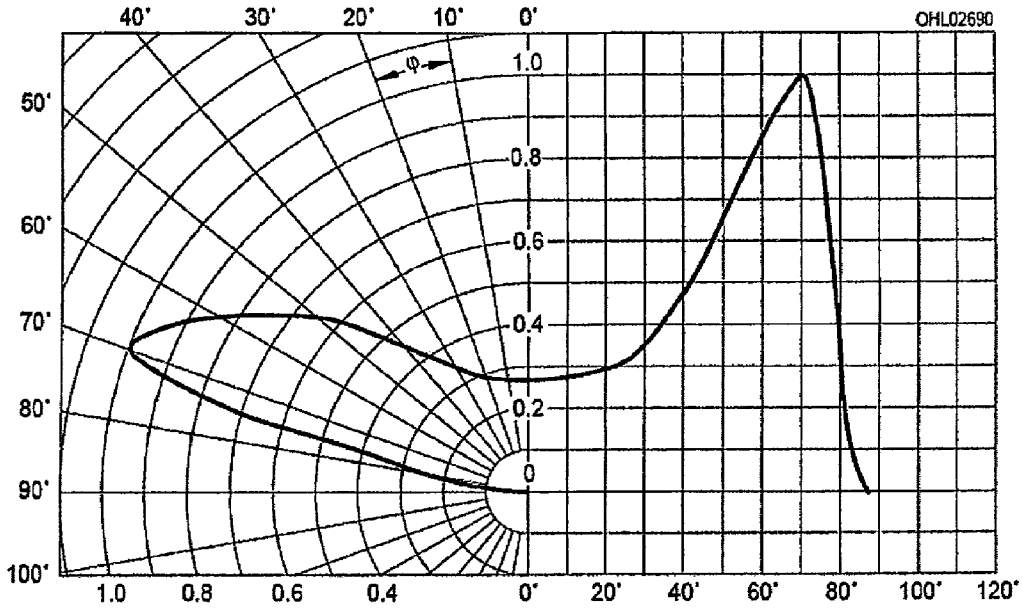
FIG. 3 show a plot of a light intensity distribution normalized to the light intensity maximum in a polar diagram for a wide-angle lens.

FIG. 3 shows a plot of a light intensity distribution normalized to a light intensity maximum at an angle $\phi=70°$ (corresponding to an aperture angle of the lens of 140°) in a polar diagram for a possible wide-angle lens that is irradiated by means of a set of six surface mounted LEDs.

Typically, the LED light sources used here have as such (e.g. an LED chip) a substantially Lambertian emission characteristic. It is only by virtue of the lens disposed downstream that the wide-angle emission characteristic is achieved. In the case of the arrangement shown, the light intensity in the direction of the optical axis is only approximately 25% of the light intensity maximum. Consequently, in a light emission occurs substantially only at a considerable angle relative to the optical axis (0°), namely between approximately 35° and 80°, especially between 50° and 80°. However, the aperture angle can also be designed to be larger or smaller. Moreover, the aperture angle need not be symmetrical with respect to the optical axis of the light source(s). Furthermore, the aperture angle can prove to be different in the circumferential direction, e.g. of the type 120°×80°.

Figure 4:
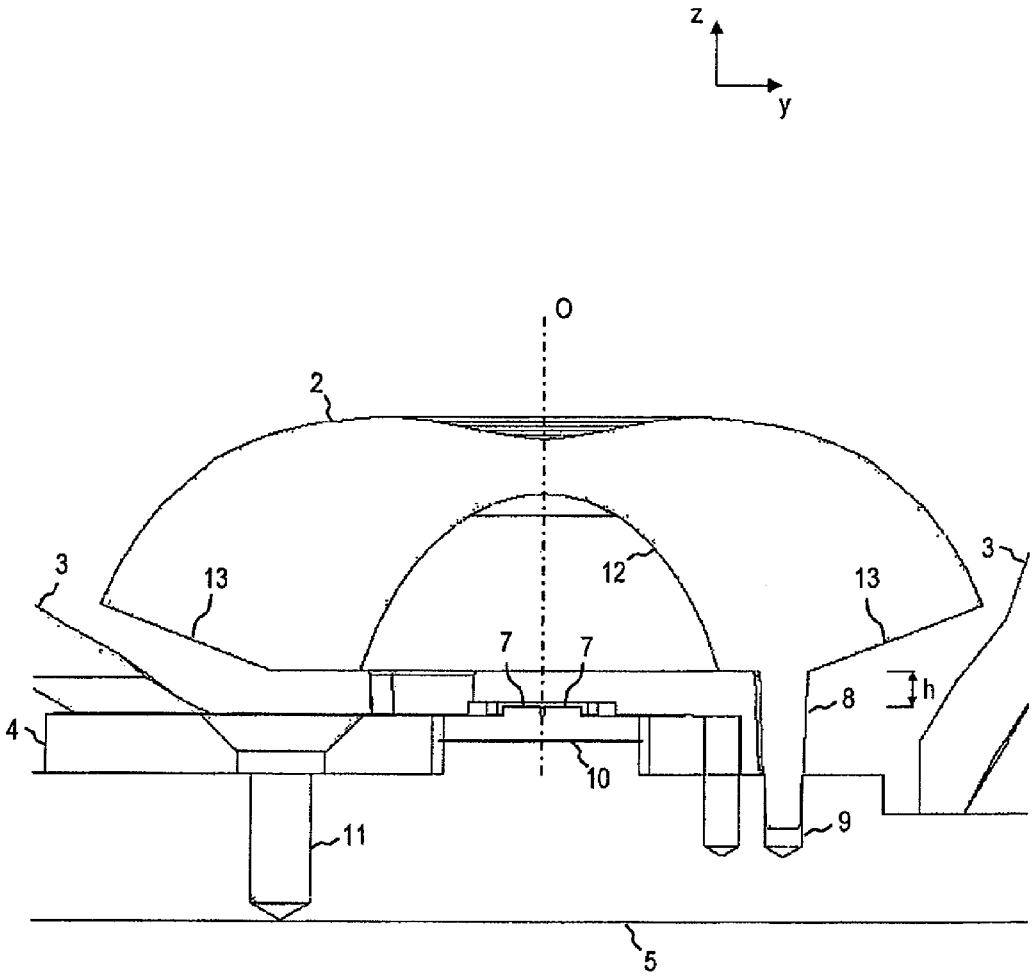
FIG. 4 shows an enlarging excerpt from FIG. 2.

FIG. 4 shows an enlarging excerpt from FIG. 2 in the region of the lens 2, which is produced from a transparent polymer material according to the prior art. The lens 2 is inserted, by means of integrally formed legs 8 for connection to the base board 5, into corresponding cutouts or holes 9 in the base board 5. The six light sources 7, two of which are depicted here, are LEDs which emit white light and are surface mounted on a carrier element 10. The carrier element 10 is specifically embodied as a printed circuit board, on which the six LEDs 7 are arranged in two rows of in each case three rectangular single LED chips 7 (2×3 matrix arrangement), thus resulting in a rectangular overall arrangement having an edge length of approximately 3 mm in the longitudinal direction and approximately 2 mm in the transverse direction. The carrier element 10 is fitted on the bonding board 4, which is in turn connected to the base board by means of a screw connection 11.

The LEDs 7 emit their light predominantly onto the underside of the lens 2 (light entrance surface). Only a small proportion of <5% is radiated through under the lens 2 directly onto the reflector 3. The light entrance surface of the lens 2 has a concavely, e.g. parabolically or elliptically shaped cavity or cutout ("dome") 12. In the embodiment shown here, the light entrance surface substantially corresponds to the surface of the dome 12. From the light entrance surface or the dome 12, the light rays are directed through the lens 2 to the upper surface thereof, from which they are emitted in wide-angle fashion. This lens 2 ensures that approximately 70% of the power radiated from the light sources 7 is passed to the reflector 3. Merely for the sake of better clarity, the electrical lines and, if appropriate, electronics required for the operation of the lighting device are not depicted here.

The lens 2 is arranged, in particular, at a distance of approximately 8 mm from the group of light emitting diodes 7. The distance between the lens 2 and the group of LEDs 7 is therefore more than 2 times the maximum linear dimension of the group of LEDs 7, which in this case is the diagonal of the rectangular arrangement with a value of approximately 3.6 mm. An excessively large distance between the lens 2 and the LEDs 7 should be avoided since, although the thermal loading of the lens 2 decreases further as a result, the arrangement then becomes very large. A maximum distance of 20 mm or of approximately 5 times the maximum linear extent of the group of LEDs 7 has proved to be expedient in the case of the components that are usually used.

The lens 2 has a diameter of approximately 17 mm. The radiation entrance surface 12 of the lens 2 is therefore arranged at a distance from the surface of the LEDs 7 which corresponds to more than one third of the diameter of the radiation entrance surface of the lens 2, even approximately to half in the present example. An excessively large distance between lens 2 and LEDs 7 would require a very large lens diameter in order to capture with the lens 2 a proportion of the emitted light equal in magnitude to that in the case of a lens 2 situated closer to the LEDs 7. As a result, however, the production outlay increases and the module 1 becomes very large and unwieldy. It has proved to be advantageous to choose the distance between radiation entrance surface of the lens 2 and LED 2 to be smaller than the lens diameter.

The outer ring-shaped, beveled lateral surface 13 of the lens 2 is configured such that a minimized total reflection of the lens 2 results, which in turn leads to a lower sensitivity of the lens 2 toward manufacturing tolerances and misalignment.

In this FIG. 4, the distance discussed corresponds to the shortest distance between an LED 7 and the lens 2.

Figure 5:
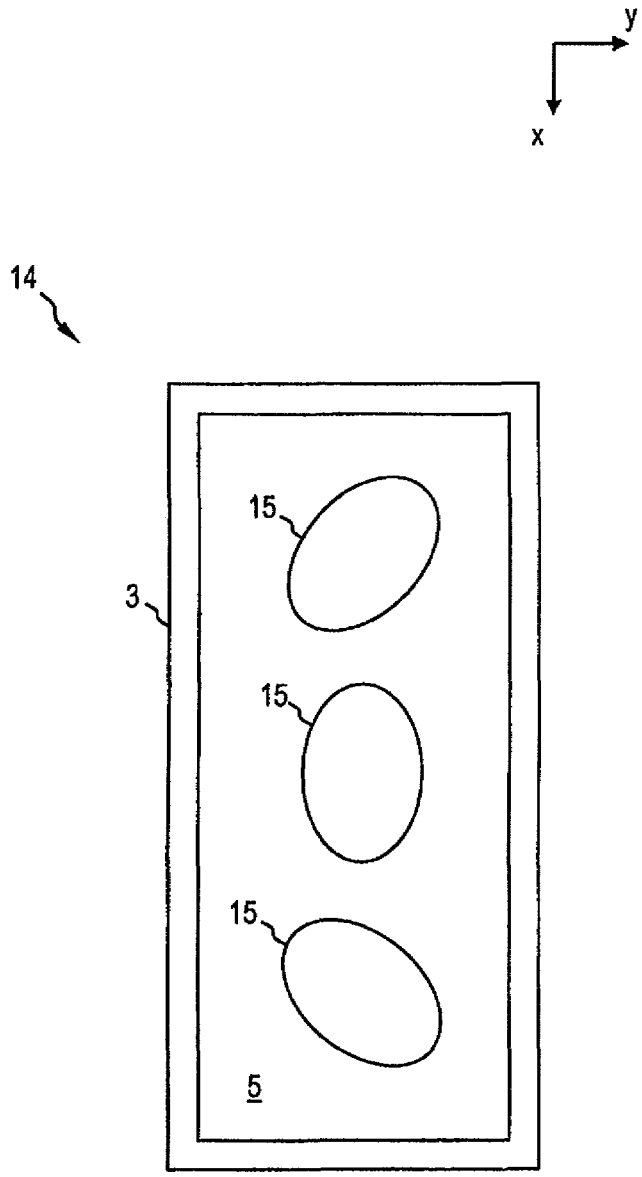
FIG. 5 shows a further embodiment of a lighting device in plan view.

FIG. 5 shows, in plan view, a simplified illustration of a further embodiment of a lighting device 14, wherein now three sets of light source(s) and associated wide-angle lens 15 are arranged on a base board 5 and in a manner surrounded by a common reflector 3. Each set having a combination of one or a plurality of light sources and a common wide-angle optical unit 15 has the same basic components, for example the lens 15, which is now embodied in an elliptical fashion, but here the orientation of the lenses 15 in the (x, y) plane is different. Thus, two adjacent lenses 15 in the x, y plane are offset by in each case 45° with respect to one another. It is also possible, even though not shown explicitly in this FIG. 5, for the optical axes of the lenses 15 to be angularly offset with respect to one another, for example with respect to the z-axis in this embodiment, such that, for example, the upper set having its combination of light source(s) and lens 15 is inclined at a specific angle with respect to the x-axis, the optical axis of the central set coincides with the z-axis and the optical axis of the lower set is inclined relative to the z-axis by the same angle as that of the upper set, but in a different direction, here for example in the opposite direction.

It goes without saying that the present invention is not restricted to the embodiments shown.

Thus, instead of the use of light emitting diodes or LED chips as light sources, any other suitable light source can also be used, e.g. a laser diode.

When light emitting diodes are used, it is possible to use inorganic light emitting diodes, for example based on InGaAlP or AlInGap or InGaN, but also AlGaAs, GaAlAs, GaAsP, GaP, SiC, ZnSe, InGaN/GaN, CuPb, etc., or else OLEDs, for example. The use of thin-GaN technology is particularly advantageous. Different construction types can also be used, such as surface mounted LEDs.

Light sources which radiate in the same color can be used. Such light sources which radiate in the same color can be light sources which radiate in multichrome or monochrome fashion. As light sources which radiate in the same color in multichrome fashion, it is possible to use, in particular, light sources which emit white light, for example LEDs which emit blue light and are provided with a phosphor and in which the phosphor wavelength-converts part of the blue light emitted by the LED into yellow light, as a result of which a white mixed light is produced overall. As an alternative, the use of UV LEDs in conjunction with wavelength conversion material that converts the UV light from the LEDs as completely as possible into visible light, in particular white light, is conceivable. However, other color combinations are also possible, in particular for generating a white light. In particular, "hard" or "soft" white can be generated as white light.

An individual light source or a combination of a plurality of light sources, for example a cluster of a plurality of light sources, e.g. LED chips, is conceivable as the light source. The associated light sources of the cluster, in particular LED cluster, can be of different colors with respect to one another and produce a white light with color mixing. In particular, an LED cluster composed of red, green and blue emitting individual light sources (RGB) is conceivable. In this case, one or a plurality of LEDs can be used per color, e.g. depending on the desired color intensity. Moreover, light sources, in particular LEDs, of another color can be admixed, e.g. yellow or amber LEDs. The light intensity of the light sources is preferably adjustable, e.g. dimmable, e.g. by means of regulation of a current fed to the light sources.

As an optical unit which enables a wide-angle emission characteristic, it is possible to use, in particular, a lens, e.g. an ARGUS lens. In order to enable a wide emission characteristic, however, combinations of a plurality of lenses are also possible, even if this is not preferred for reasons of cost-effective and simple mounting. Overall, it is possible to allow a smaller portion of the light emitted in wide-angle fashion not to be reflected by the reflector.

Generally, the wide-angle combination of light source(s), optical unit and, if appropriate, reflector can enable rotationally symmetrical, mirror-symmetrical and/or asymmetrical light distribution patterns.

Generally, the reflection surface of the reflector can be structured or non-structured. As structuring it is possible to provide, in particular, different facet regions on the reflection surface, which, aside from being extended in elongate fashion, for example also have a form restricted in both dimensions, e.g. a square or rectangular form.

Generally, it is also possible to provide a plurality of sets each having a wide-angle combination of light source(s) and optical unit, which can have a common reflector or reflection region. The optical axes of the respective sets can be offset and/or tilted relative to one another. It is also possible for the form of the emission pattern and/or the dimensioning thereof to differ among different sets. Moreover, an arrangement of the sets in a series or in any desired area pattern, for example a rotationally symmetrical area pattern with or without a central set, is conceivable.

Generally, it is also possible to couple a plurality of such lighting devices, if appropriate with other lighting devices, to form a luminaire.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Lighting module
2 Lens
3 Reflector
4 Bonding board
5 Base board
6 Leadthrough
7 Light source
8 Leg
9 Hole
10 Carrier
11 Screw/screw hole
12 Dome
13 Total reflection surface
14 Lighting module
15 Lens
h Mounting distance

The invention claimed is:

1. A lighting module, comprising at least:
at least one light source;
a respective lens arranged at a distance from the light source; and
a reflector which surrounds the at least one light source completely about the optical axis;
wherein the lens is configured and arranged to have a wide-angle emission characteristic and to direct only a portion of the light incident from the light source onto the reflector, wherein the portion is at least 30%.

2. The lighting module as claimed in claim 1,
wherein the lens is configured and arranged to direct a portion of more than 50% of the light incident from the light source onto the reflector.

3. The lighting module as claimed in claim 1,
wherein the lens is configured and arranged to direct not more than 70% of the light incident from the light source onto the reflector.

4. The lighting module as claimed in claim 1,
wherein the lens is configured and arranged to emit light along an optical axis with not more than 30% of a maximum light intensity.

5. The lighting module as claimed in claim 1, wherein at least one light source is applied on at least one carrier element, wherein the carrier element has a plurality of light sources combined in a group of light sources.

6. The lighting module as claimed in claim 1, wherein a light entrance surface—facing the light source—of the lens is arranged at a distance of at least 2.5 mm from the surface of the light source.

7. The lighting module as claimed in claim 1, wherein a light entrance surface—facing the light source—of the lens is arranged at a distance from a surface of the light source which corresponds to at least the maximum linear dimension of at least one of the light source and of the group of light sources.

8. The lighting module as claimed in claim 1, wherein a light entrance surface—facing the light source—of the lens is arranged at a distance from a surface of the light source which corresponds to at least one quarter of a diameter of the light entrance surface of the lens.

9. The lighting module as claimed in claim 1, wherein the light entrance surface—facing the light source—of the lens is arranged at a shortest distance of at most 30 mm from the surface of the light source.

10. The lighting module as claimed in claim 1, wherein the light entrance surface—facing the light source—of the lens is arranged at a shortest distance from the surface of the light source which corresponds at most to eight times the maximum linear dimension of at least one of the light source and the group of light source.

11. The lighting module as claimed in claim 1, wherein a light entrance surface—facing the light source—of the lens is arranged at a shortest distance from the surface of the light source which corresponds at most to one and a half times the diameter of the light entrance surface of the lens.

12. The lighting module as claimed in claim 1, wherein the lens comprises a diffraction grating.

13. The lighting module as claimed in claim 1, wherein at least one reflection surface of the reflector is structured; wherein the at least one reflection surface of the reflector is provided with facets such that light beams reflected from a plurality of facets completely overlap.

14. The lighting module as claimed in claim 1, wherein at least one reflection surface of the reflector is structured, wherein the reflector has a rectangular basic form in which the two shorter sides have no facets and the two longer sides each have a plurality of facets.

15. The lighting module as claimed in claim 1, which has a pattern selected from a group consisting of: a rotationally symmetrical light distribution pattern; a mirror-symmetrical light distribution pattern; and an asymmetrical light distribution pattern.

16. The lighting module as claimed in claim 1, which has a plurality of sets each composed of at least one light source and a lens disposed downstream, wherein a common reflector is disposed downstream of the plurality of sets, wherein the lens comprises a plurality of lenses having different orientations.

17. The lighting module as claimed in claim 1, wherein the lens comprises a plurality of lenses having different orientations, the optical axes of which are angularly offset with respect to one another.

18. A luminaire, comprising at least one lighting module, the lighting module comprising:

at least one light source;

a respective lens arranged at a distance from the light source; and a reflector which surrounds the at least one tight source completely about the optical axis;

wherein the lens is configured and arranged to have a wide-angle emission characteristic and to direct only a portion of the light incident from the light source onto the reflector, wherein the proportion is at least 30%.

19. The luminaire as claimed in claim 18, which produces a sharp bright/dark boundary in the target region.

20. A lighting method, comprising:

directing only a portion of at least 30% of a light emitted by at least one light source onto a lens arranged at a distance therefrom is directed onto a reflector which surrounds the light source completely about the axis, wherein the light emitted by the lens has a wide-angle emission characteristic.

* * * * *